US005590618A

United States Patent [19]

Marshall

[11] Patent Number: 5,590,618

[45] Date of Patent: Jan. 7, 1997

[54] ROTATABLE TUBULAR METAL LIFTARM

[76] Inventor: Stephen R. Marshall, 20627 Mainland View La. NE., Suquamish, Wash. 98392

[21] Appl. No.: 573,483

[22] Filed: Dec. 15, 1995

Related U.S. Application Data

[63] Continuation-in-part of Ser. No. 490,881, Jun. 14, 1995, abandoned, which is a continuation of Ser. No. 222,405, Apr. 4, 1994, abandoned.

[51] Int. Cl.[6] ..... B63B 17/00

[52] U.S. Cl. ..... 114/343; 114/364

[58] Field of Search ..... 212/307, 180, 212/901, 223; 114/364, 343, 365; 414/137.9, 142.8, 543, 678, 626, 540; 254/334, 335, 365, 268, 210; 72/369; 248/231, 62; 138/143, 172

[56] References Cited

U.S. PATENT DOCUMENTS

| | | | |
|---|---|---|---|
| 1,774,996 | 9/1930 | Rohrmann et al. | 212/232 |
| 2,616,645 | 11/1952 | Kindorf et al. | 243/62 |
| 2,699,203 | 1/1955 | White | 155/198 |
| 3,126,100 | 3/1965 | Christensen | 211/126 |
| 4,880,345 | 1/1989 | Beaupre | 414/137.9 |
| 4,979,865 | 12/1990 | Strickland | 414/486 |

FOREIGN PATENT DOCUMENTS

| | | |
|---|---|---|
| 130741 | 5/1901 | Germany . |
| 384386 | 2/1965 | Sweden . |
| 23790 | of 1912 | United Kingdom . |

*Primary Examiner*—Edwin L. Swinehart
*Attorney, Agent, or Firm*—J. Robert Cassidy, P.S.

[57] ABSTRACT

A liftarm assembly having: i) a mounting socket and base assembly for attachment to a support; ii) a vertically extending mounting tube non-rotatably but pivotably secured to the mounting socket and base assembly; iii) a sheave mounted in the mounting tube for rotation about a horizontal axis wherein the sheave projects laterally out of the mounting tube; iv) a tubular metal liftarm mounting in the mounted tube for rotation about a vertical axis wherein the tubular liftarm is devoid of internal pulleys and external braces and other protuberances; v) the tubular liftarm including a lower vertically extending linear portion for insertion into the mounting tube, a laterally extending cantilevered upper portion, and an intermediate portion joined to the upper and lower portions by smooth curves; vi) a fitting coupled to the outboard end of the cantilevered upper portion and including a sheave journaled for rotation about a horizontal axis; vii) a load line having its outboard free end secured to the cantilevered upper portion of the liftarm and it opposite inboard free end reeved about the sheave in the fitting, through the tubular metal liftarm and mounting tube, about the sheave in the mounting tube, and laterally out of the mounting tube for attachment to a suitable winch with the portion of the load line intermediate its point of attachment to the upper portion of the liftarm and the fitting sheave defining a bight; and viii), a sheave block and support hook suspended from the lower end of the bight.

23 Claims, 6 Drawing Sheets

ROTATABLE TUBULAR METAL LIFTARM

RELATED APPLICATIONS

The present application is a Continuation-In-Part application based, in part, on Applicant's prior U.S. application Ser. No. 08/490,881 filed Jun. 14, 1995, which prior application Ser. No. 08/490,881: i) is now abandoned; and ii), was, in turn, a continuation of Applicant's then co-pending, now abandoned, U.S. application Ser. No. 08/222,405 filed Apr. 4, 1994.

BACKGROUND OF THE INVENTION

1. Technical Field

The present invention relates generally to lift devices; and, more particularly, to a rotatable tubular metal liftarm assembly suitable for mounting on the deck of a sailboat or similar vessel for on-loading and/or off-loading equipment and supplies. More specifically, the present invention relates to a rotatable tubular metal liftarm assembly which is: i) simple in construction; ii) totally devoid of external supports, braces, pins and similar protuberances; iii) devoid of internal sheaves and/or pulleys; and iv), capable of freely rotating in either direction about its vertical axis through angles of up to 360° without undue twisting of, or otherwise fouling, the load line used to raise/lower objects being on-loaded onto or off-loaded from the vessel.

In its preferred embodiment, the load line is reeved through the tubular liftarm assembly which is devoid of internal sheaves, pulleys or the like; and, consequently, a load carried by the cantilevered free outboard end of the tubular liftarm does not create a rotational force tending to swing the liftarm about its vertical rotational axis, thereby preventing the tendency of heavy loads to inadvertently swing inboard and strike the side of the vessel, its siderail and/or other objects or persons. Moreover, the absence of external supports, braces, pins and/or similar protuberances not only contributes to the smooth, clean, streamlined appearance of the overall device, but, more significantly, enhances the capability of the rotatable liftarm assembly to be freely rotated about its vertical rotational axis during on-loading and/or off-loading operations without risk that the suspended load will be impeded, damaged or will cause damage to the liftarm assembly.

The present invention takes advantage of conventional on-board winches which commonly employ power ratios on the order of 16:1 or more and which are used to pay in or pay out a load line which has its free inboard end wound thereabout during on-loading and/or off-loading operations.

2. Background Art

The prior art is replete with numerous types of liftarm assemblies for sailboats and the like. Typically, such liftarm assemblies employ multi-part block-and-tackle arrangements suspended from the outboard end of a horizontal leg on a fabricated lift-arm assembly comprising aluminum or stainless steel tubing employing external struts, braces and/or pins for reinforcement and/or internal pulleys or sheaves about which the load line is reeved. Such prior art devices are typically quite bulky and capable of only limited rotational movement. Moreover, multi-part block-and-tackle arrangements are disadvantageous because: i) they tend to foul and tangle badly unless kept under tension at all times; ii) to lower a 4:1 tackle from the top of the liftarm to the water level requires paying out four times that distance of line which must be run through the sheave blocks of the tackle arrangement; iii) a heavy consistent downward pull must be maintained on the lower sheave block to overcome all of the friction and line movement in the tackle array; iv) attention must be constantly directed to the inboard end of the tackle system to prevent snags while paying the load line outboard; and v), the operator is required to pull the tackle line inwardly, generally at shoulder level, precisely along the top of the liftarm in order to prevent the tendency of the liftarm to swing inboard and slam the load into the side of the boat or into other objects or persons.

Rohrmann et al U.S. Pat. No. 1,774,996, which issued more than 65 years ago, while not representative of typical liftarm assemblies of the type used on sailboats and like vessels, is of general interest for its early disclosure of a cantilevered type liftarm with an internally reeved load line use to raise and lower the lid of cooking utensils. The device is characterized by the inclusion of a sheave 24 located internally of the horizontal cross arm with the load line being trained about the internal sheave. Such a device is not intended for, nor capable of, transferring heavy loads.

Swiss Pat. No. 384,386 issued to Carrosserie Torsa, Schallbetter & Cie S. A. as the assignee of ReneSalamin, discloses a liftarm assembly similar to that in the Rohrmann et al patent, but which is shown as having utility for raising or lowering small boats to or from a stowed position on top of a car or similar vehicle. As in Rohrmann et al, the tubular liftarm employs internal sheaves or pulleys about which the load line is trained. Additionally, because of the cantilevered construction and the magnitude of the weights to be lifted/lowered, the liftarm is provided with external support struts.

As recently as 1990, Strickland U.S. Pat. No. 4,979,865 issued disclosing a liftarm structure for loading and unloading pick-up trucks wherein the cantilevered liftarm, best shown in Strickland FIG. 4, employs an internal guide pulley 32 and external support struts or legs 27, 40, 41.

Other patents of miscellaneous interest include: i) Beaupre U.S. Pat. No. 4,880,345 [a load hoist assembly for boats]; ii) White U.S. Pat. No. 2,699,203 [an automobile driver's armrest]; iii) Christensen U.S. Pat. No. 3,126,100 [a clamp assembly for attaching a utility tray to a vertical column]; iv) Kindorf et al U.S. Pat. No. 2,616,645 [a pipe hanger]; v) German Pat. No. 130,741 [an internal diametrically extending stiffener member bisecting a tubular element]; and vi), UK Pat. No. 23,790 (1912) [a clip for securing articles to handle-bars on cycles].

Thus, the prior art devices described hereinabove are characterized by their complexity, lack of flexibility, requirements for internal sheaves or pulleys, and requirements for external support struts, braces and/or pins or similar external protrusions which tend to limit free rotation of the liftarm and any supported load about the liftarm's vertical axis. The use of conventional block-and-tackle assemblies of the types commonly employed with such conventional liftarm assemblies is expensive and fraught with difficulties and danger due to the need to maintain the load line under tension at all times so as to prevent tangles and other undue snags. Moreover, conventional block-and-tackle arrangements have limited power ratings, require excessive lengths of load line, and require constant attention by the operator.

SUMMARY OF THE INVENTION

The present invention comprises a simple, yet rugged, low-cost liftarm assembly employing a single cantilever-type liftarm through which the load line is freely reeved without requiring internal sheaves or pulleys within the liftarm and without requiring external support struts, braces, pins and/or other types of external projections. The liftarm assembly of the present invention is characterized by: i) a continuous stainless steel tubular liftarm assembly devoid of internal pulleys and/or sheaves and external support struts, braces, pins or other projections; and ii), the ability to easily reeve the load line about an external outboard sheave mounted at the outboard cantilevered end of the liftarm assembly, through the liftarm, about an inboard sheave rotatably mounted in a fixedly positioned sheave box disposed at the lower end of a tubular mounting support for the liftarm assembly, and laterally to: a) a conventional cockpit winch mounted on the deck of the sailboat; b) a conventional winch fixedly secured to the liftarm assembly siderail mounting device; or c) any suitably positioned conventional winch, all of which are capable of output power ratios on the order of 16:1 or greater.

Notwithstanding the foregoing, the arrangement is such that the cantilevered liftarm assembly is freely rotatable in either direction about its vertical axis through angles up to 360° without undesirable twisting of the load line. At the same time, the only force imposed on the liftarm assembly by the load being raised or lowered is imparted vertically at the free outboard end on the cantilevered liftarm without imposing any rotational force to the liftarm even during raising and/or lowering of heavy loads, thereby minimizing the danger that supported loads will be inadvertently swung inboard during a load raising or lowering operation and preventing consequent damage to the load, the side of the boat and/or its siderail, any deployed dinghy and/or crew members or other individuals in the dinghy, or onboard the sailboat or similar vessel.

The foregoing advantages are achieved by providing a cantilevered stainless steel tubular liftarm employing one or more internal concentric tubular stainless steel stiffening member(s) positioned in the region of the vertical portion of the tubular liftarm most susceptible to undesired flexure, yet wherein the load line can be easily reeved axially through the tubular liftarm assembly and any internal tubular stiffening member(s). In the practice of the present invention, the lower vertically extending end of the liftarm assembly is rotatably mounted within an upright, generally vertical, mounting tube affixed to the deck of the vessel with the mounting tube including a sheave box and rotatable inboard sheave lying in a vertical plane substantially bisecting a deck-mounted cockpit winch so that the lower inboard end of the load line can be reeved about the inboard sheave, led directly to the winch, and wound about the winch. Thus, the only force applied directly to the liftarm assembly is the weight of the load—i.e., a vertical force—which is suspended vertically below the outboard sheave on the cantilevered outboard end of the liftarm assembly.

More specifically, it is a general object of the invention to provide a rotatable liftarm assembly for use on sailboats and the like which is: i) rugged, yet simple in construction; ii) economical; iii) light weight; iv) portable and, therefore, readily storable when not in use; and v), which is characterized by its sleek customized appearance as contrasted with conventional fabricated hoists employing block-and-tackle arrangements.

It is further an object of the invention to provide a cantilever-type tubular liftarm assembly devoid of internal sheaves, pulleys and the like and which permits a load line to be easily reeved through and/or removed from the tubular liftarm in a matter of a few seconds.

An ancillary object of the present invention is to provide a rotatable liftarm assembly of the foregoing character wherein the load line is reeved through the tubular liftarm and is, therefore, coincident with the rotational axis of the liftarm assembly, thus insuring that the only force applied to the liftarm assembly during use is the vertical force imposed by a load suspended from the cantilevered outboard end of the assembly, thereby enabling free rotation of the liftarm assembly about its vertical rotational axis while insuring no rotational forces are imposed thereon which might cause the liftarm assembly to inadvertently swing inboard and slam the suspended load against the side of the sailboat, its siderail, the dinghy, and/or crew members and other personnel in or on either the dinghy or the sailboat.

DESCRIPTION OF THE DRAWINGS

These and other objects and advantages of the present invention will become more readily apparent upon reading the following Detailed Description and upon reference to the attached drawings, in which:

FIG. 7 is an exploded isometric view of an adjustable mounting assembly for attaching the deck mounted rotatable tubular metal liftarm of the present invention to the siderail of a conventional sailboat or the like;

Figure 1:
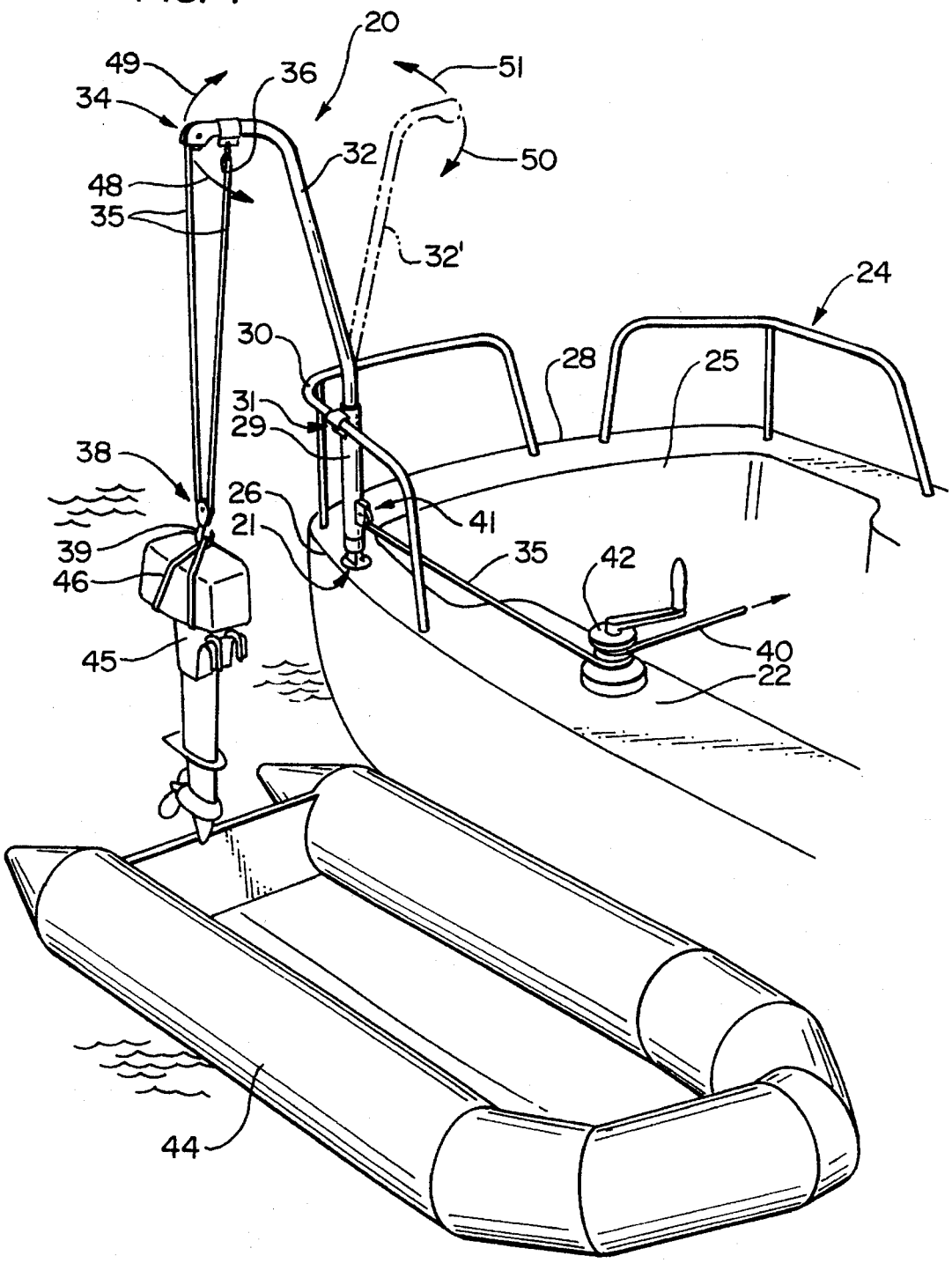
FIG. 1 is a fragmentary isometric view here depicting an exemplary rotatable tubular metal liftarm assembly embodying the present invention mounted on the gunwale of an aft cockpit sailboat with the liftarm assembly being used to transfer a load—here a conventional outboard motor—between a stowed position onboard the sailboat and a deployed position in or on an inflatable dinghy or similar small boat.

While the invention is susceptible of various modifications and alternative forms, specific embodiments thereof have been shown by way of example in the drawings and will herein be described in detail. It should be understood, however, that it is not intended to limit the invention to the particular forms disclosed; but, on the contrary, the intention is to cover all modifications, structural equivalents, equivalent structures, and/or alternatives falling within the spirit and scope of the invention as expressed in the appended claims. Thus, in the appended claims, means-plus-function clauses and similar clauses are intended to cover: i) the structures described herein as performing a specific recited function; ii) structural equivalents thereof; and iii), equivalent structures thereto. For example, although a nail and a screw may not be deemed to be structural equivalents since a nail employs a cylindrical surface to secure wooden parts together while a screw employs a helical surface, in the art broadly pertaining to the fastening of wooden parts, a nail and a screw should be deemed to be equivalent structures since each perform the recited fastening function.

DETAILED DESCRIPTION

Figure 2:
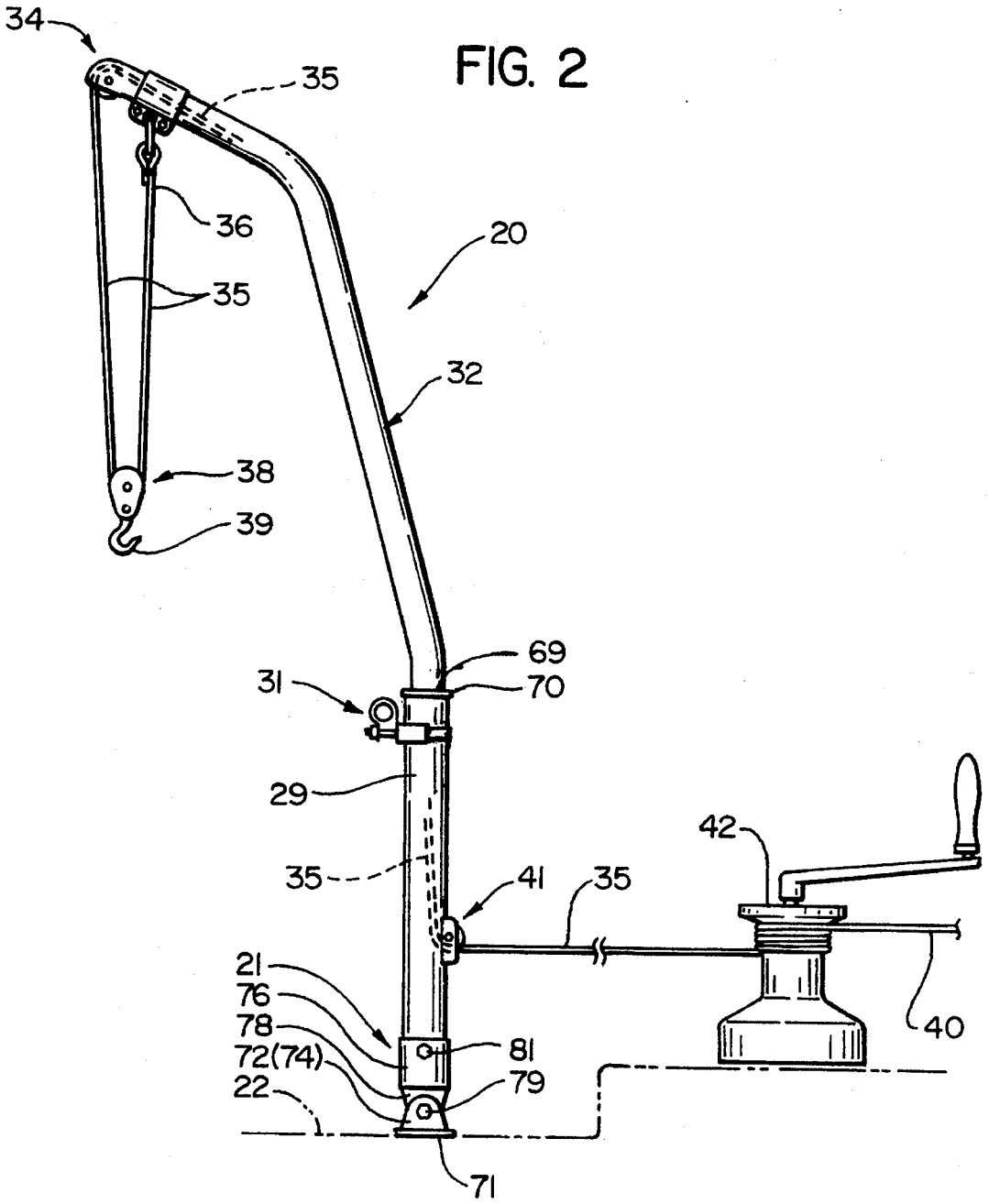
FIG. 2 is a side elevational view of an exemplary rotatable tubular metal liftarm assembly embodying the present, invention here illustrated with the free end of the load line being wrapped about a suitable and completely conventional cockpit winch.

Turning now to the drawings, and directing attention first to FIGS. 1 and 2 conjointly, there has been illustrated a cantilever-type rotatable tubular metal liftarm assembly, generally indicated at 20, embodying features of the present invention. As here shown, the exemplary liftarm assembly 20 includes: i) a mounting socket and base assembly 21 adapted to be fixedly secured no the deck 22 of a conventional sailboat or similar vessel 24 intermediate the cockpit 25 and gunwale 26 adjacent the stern 28 of the sailboat 24; ii) a vertically extending mounting tube 29 non-rotatably secured to the socket and base assembly 21 at its lower end and to the sailboat's siderail 30 adjacent its upper end by any suitable mounting bracket assembly, generally indicated at 31; iii) a tubular stainless steel cantilever-type liftarm, generally indicated at 32, rotatably received within the non-rotatable vertically extending mounting tube 29 and capable of rotation about a vertical axis; and iv), an outwardly extending outboard sheave assembly, generally indicated at 34, affixed to the upper cantilevered free outboard end of the liftarm 32.

A load line 35, secured at its free outboard end 36 to the cantilevered outboard end of the liftarm 32, depends therefrom and is reeved through a lift sheave assembly, generally indicated at 38, including a lift hook 39, with the load line 35 extending upwardly from the lift sheave assembly 38 to the outboard sheave assembly 34 mounted at the free cantilevered outboard end of the liftarm 32. Load line 35 is reeved: i) about the outboard sheave assembly 34; ii) inwardly and downwardly through the tubular liftarm 32 along a line substantially coincident with the rotational axis of the rotatable liftarm 32; and iii), axially through the vertically extending mounting tube 29, with the free inboard end 40 of the load line 35 extending laterally from the lower end of the mounting tube 29 through a sheave box assembly, generally indicated at 41, which lies in a vertical plane bisecting a deck-mounted cockpit winch 42, with the free inboard end 40 of the load line 35 being wrapped about the winch 42.

As best shown in FIG. 1, the rotatable tubular metal liftarm assembly 20 of the present invention finds particularly advantageous use in transferring equipment, supplies and the like between the deck of a sailboat or similar vessel and a point external to the sailboat 24—for example, a dinghy, generally indicated at 44—during either an on-loading operation or an off-loading operation. In the illustrative arrangement, the rotatable liftarm assembly 20 is shown transporting an outboard motor 45 supported by an adjustable strap assembly 46 of the type disclosed in Applicant's co-pending application Ser. No. 08/410,118, filed Mar. 24, 1995, and entitled "Adjustable Strap Assembly For Raising, Lowering and Transporting Outboard Motors and Similar Heavy Bulky Objects: and, Methods of Use Thereof", with the strap assembly 46 engaged with the lift hook 39 associated with the lift sheave assembly 38. Those skilled in the art will appreciate that, as shown, the outboard motor 45 may be in the process of being transferred from the sailboat 24 to the dinghy 44 during an off-loading operation or, alternatively, from the dinghy 44 to the sailboat 24 during an on-loading operation.

Assuming that an on-loading operation is in progress, the cockpit winch 42 would be rotated in a counter-clockwise direction as viewed in FIG. 1 to pay in the load line, thus raising the outboard motor 45 to a sufficient height where it can be manually swung inboard to position the motor 45 over the sailboat's cockpit 25. Manual inboard swinging of the liftarm 32 is accomplished by simply grasping the outboard motor 35, the bight of the load line 35 intermediate the motor 45 and the outboard sheave assembly 34, or the outboard end of the liftarm 32, and pulling the motor inboard. Since the cantilevered liftarm 32 is rotatably mounted within the non-rotatable mounting tube 29, the load—here an outboard motor 45—can be freely swung aboard by rotating the assembly in the direction of either arrow 48 or 49 to the phantom line position shown at 32' in FIG. 1. At this point, the winch 42 is rotated in a clockwise direction as viewed in FIG. 1 to pay out the load line 35 and lower the motor 45 into the sailboat's cockpit 25. During an off-loading operation when the outboard motor 45 is to be lowered into the dinghy 44, it will be first raised from the cockpit 45 while the liftarm 32 is in the phantom line position 32', rotated outboard in the direction of either arrow 50 or 51 to the solid line position shown, and lowered into the dinghy 44 by rotating cockpit winch 42 in a clockwise direction to pay out the load line 35.

Figure 3A:
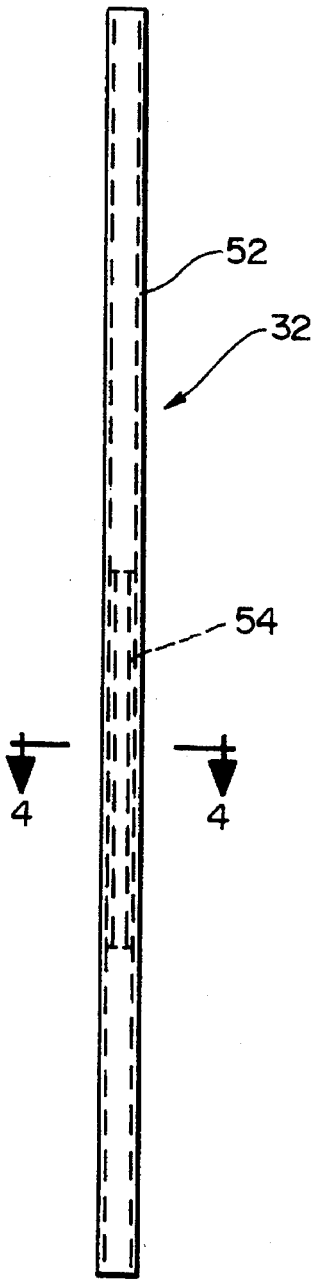
FIG. 3A is a side elevational view depicting one exemplary form of the liftarm of the present invention during assembly thereof and illustrating particularly the position of an internal tubular stiffening member snugly mounted within the tubular liftarm.
Figure 4:
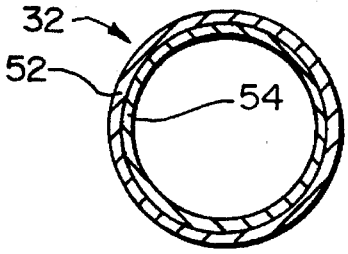
FIG. 4 is a sectional view taken substantially along the line 4—4 in FIG. 3A, here depicting details of the liftarm and tubular stiffening member.

Having the overall construction and mode of operation of the present invention as hereinabove described in mind, attention will now be directed to the specific structural details of the invention. Thus, directing attention first to FIGS. 3A and 4 conjointly, it will be noted that the tubular liftarm 32 comprises an outer stainless steel tube 52 which, in the exemplary form of the invention, is approximately 57 inches in length, having an O.D. of approximately 1.25 inches, a wall thickness of approximately 0.065 inches, and an I.D. of approximately 1.12 inches. In order to stiffen and reinforce the tubular liftarm 32 defined by the 1.25 inch O.D. tube 52, a second stainless steel stiffening tube 54 having a length of approximately 16 inches, an O.D. of approximately 1.125 inches, a wall thickness of approximately 0.065 inches and an I.D. of approximately 0.995 inches is inserted coaxially into tube 52 with its midpoint located approximately 22.5 inches from the bottom of tube 52. If necessary, tube 54 can be externally ground or polished to insure a snug telescopic fit within tube 52. Additionally, the upper peripheral edge of the inner tube 54 is preferably rounded (not shown) so as to minimize interference with free entry of the free inboard end 40 of the load line 35 during reeving of the load line through the rotatable liftarm 32.

Figure 3B:
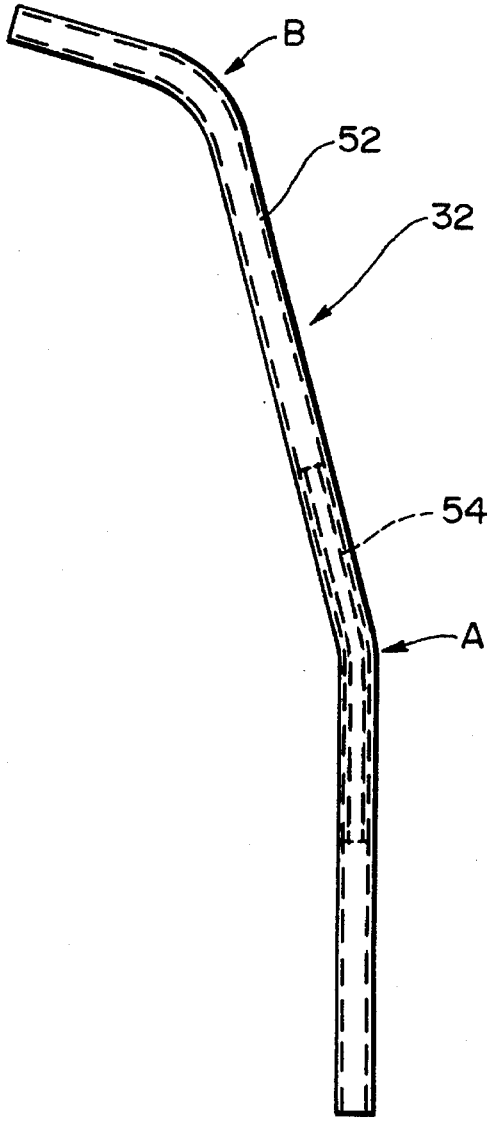
FIG. 3B is a side elevational view of the liftarm similar to FIG. 3A, but here illustrating the exemplary liftarm after bending thereof at two spaced points, one of which is located centrally of an internally positioned, telescopically mounted, tubular stiffening member, to impart a desired cantilever configuration to the rotatable tubular metal liftarm

The two concentric tubes 52, 54 are then bent through an angle of approximately 16.5° in a region, generally indicated at "A" in FIG. 3B, centered approximately 22.5 inches from the bottom of tube 52—i.e., at the approximate midpoint of the inner tube 54—thus, securely locking the two (2) tubes 52, 54 together and significantly reinforcing and strengthening the composite liftarm 32 in the region "A" where the two (2) tubes are bent. The outer tube 52 is also bent in a second region, generally indicated at "B" in FIG. 3B, approximately 9.5 inches from its upper end through an angle of approximately 60° so as to form a cantilevered liftarm 32 having a vertically extending lower end portion below region "A", an intermediate portion inclined at approximately 16.5° from the vertical axis and located between regions "A" and "B", and an outwardly and slightly upwardly extending cantilevered end portion above region "B" and inclined at included angles of approximately 76.5° with the vertical axis and approximately 13.5° with a horizontal plane.

It has been found that the exemplary dimensions hereinabove set forth for purposes of facilitating an understanding of the present invention are not critical and may be varied without departing from the spirit and scope of the invention provided only that the resulting composite cantilevered tube structure defined by tubes 52, 54 retains its approximate relative dimensions and relative shape. It has also been found that in use, the weakest point of a single tube 52 configuration is in the region "A" and, therefore, the provision of an internal, snugly fit, telescoped stiffening member in the form of a second stainless steel tube 54 extending above and below the boundaries of the region "A" provides sufficient strength to enable the composite cantilevered tubular liftarm 32 to withstand bending forces imposed by virtually any anticipated loading of the liftarm 32 during normal usage. Moreover, it has further been found that such anticipated loading during normal usage of the device does not require stiffening of the liftarm 32 in the region "B". Nevertheless, a second stiffening tube (not shown.) can be provided within the region "B" where desired.

It has further been found that a tubular liftarm 32 comprising telescoped tubular elements 52, 54 having respective uninterrupted internal diameters of approximately 1.12 inches and approximately 0.995 inches and completely devoid of internal sheaves and/or pulleys readily permits of ease in rapidly reeving a load line 35 through the composite structure. And, while it has not been found necessary, it is within the scope of the invention to provide an internal chamfer (not shown) at the upper end of the inner tube 54 so as to further facilitate entry of the load line 35 during reeving thereof.

Figure 5:
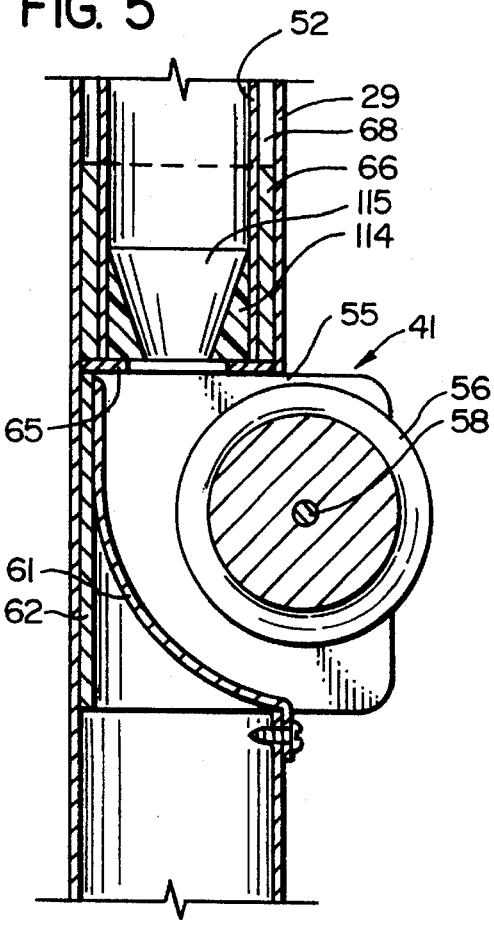
FIG. 5 is a fragmentary vertical sectional view here illustrating the lower inboard end of the liftarm assembly including a sheave box, a suitable load line deflector, bearings, and a guide insert.

In carrying out the present invention, the mounting tube 29 (best shown by reference to FIGS. 1, 2 and 5 conjointly) is preferably formed of stainless steel tubing having an O.D. of approximately 1.625 inches, a wall thickness of approximately 0.065 inches, and an I.D. of approximately 1.495 inches. The length of the mounting tube 29 will vary dependent upon the height of the sailboat's siderail 30; but, it has been found that providing a mounting tube 29 having a length of approximately 23 inches, 26 inches, 29 inches, or 32 inches will insure compatibility with virtually all sailboat siderails 30 in common use.

Figure 6:
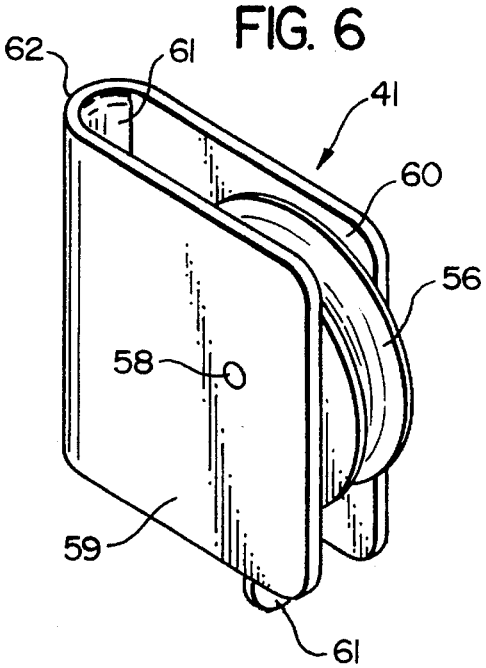
FIG. 6 is an isometric view of the sheave box, load line deflector and sheave employed with the present invention.

In keeping with the invention, the mounting tube 29 is provided with a generally rectangular cutout 55 on one side thereof approximately 8 inches above the bottom of the mounting tube. The rectangular cutout 55 is suitably sized and shaped so as to allow insertion of a generally U-shaped sheave box 41 (FIGS. 5 and 6) within which a sheave 56 is rotatably mounted on a sheave pin 58 extending transversely through the sidewalls 59, 60 of the sheave box 41. A thin, spring-like, stainless steel deflector 61 is welded or otherwise permanently affixed adjacent its upper end to the back wall 62 of the U-shaped sheave box 41. The sheave box assembly 41 is inserted into the rectangular opening 65 in the mounting tube 29 and welded in place; while the free lower end of the thin, spring-like, stainless steel deflector 61 is affixed to the mounting tube 29 by means of a screw 64, rivet (not shown), weld or other suitable fastening means.

In order to firmly, but rotatably, seat the rotatable liftarm 32 within the non-rotatable mounting tube 29, a thrust washer 65 (FIG. 5) is positioned within the mounting tube 29 on top of, and in abutment with, the upper edges of the sidewalls 59, 60 of the sheave box 41. Additionally, a lower sleeve-type bearing 66 (FIG. 5) is press-fit into the bottom of the mounting tube 29 so as to be disposed within the annular space 68 between the inner surface of the mounting tube (which has an I.D. of approximately 1.495 inches) and the outer surface at the lower end of the outer tube 52 defining the liftarm 32 (where the tube 52 has an O.D. of approximately 1.25 inches); while a similar sleeve-type bearing 69 (FIG. 2) having a peripheral outwardly extending lip 70 is press-fit into the upper end of the mounting tube 29 so as to be positioned within the annular space 68 between the mounting tube 29 and tube 52 of liftarm 32 adjacent the upper end of the mounting tube 29 with the peripheral lip 70 being seated in face-to-face abutting relation with the upper end of the mounting tube 29 and serving: i) to prevent the upper sleeve-type bearing 69 from sliding downwardly into the mounting tube 29; and ii), to prevent the siderail mounting bracket assembly 31 from slipping off the mounting tube 29 during assembly. Although not necessary because of the press-fit, both the lower sleeve-type bearing 66 (FIG. 5) and the upper sleeve-type bearing 69 (FIG. 2) can, if desired, be positively affixed to the mounting tube 29 in any desired fashion such, for example, as with one or more rivets or other fastening devices not shown).

Figure 7:
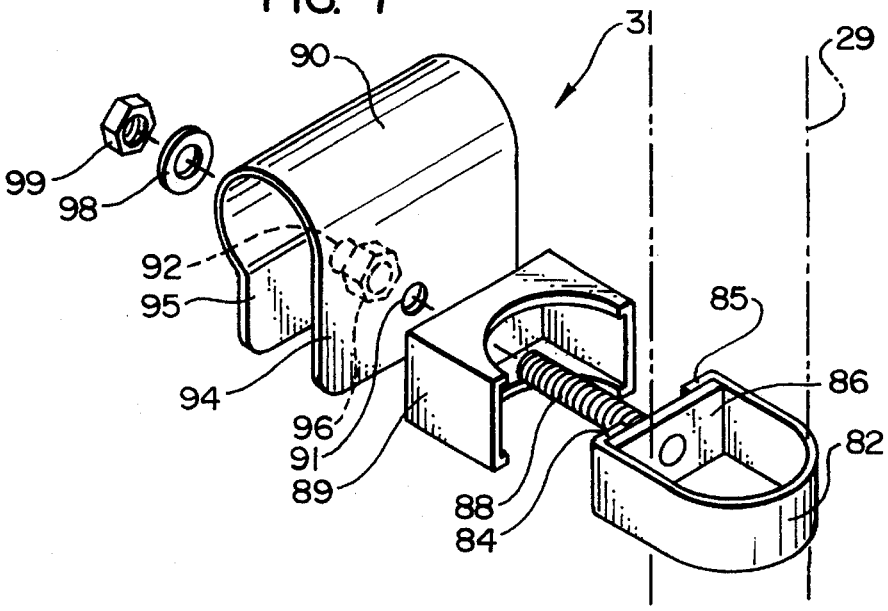
Figure 10:
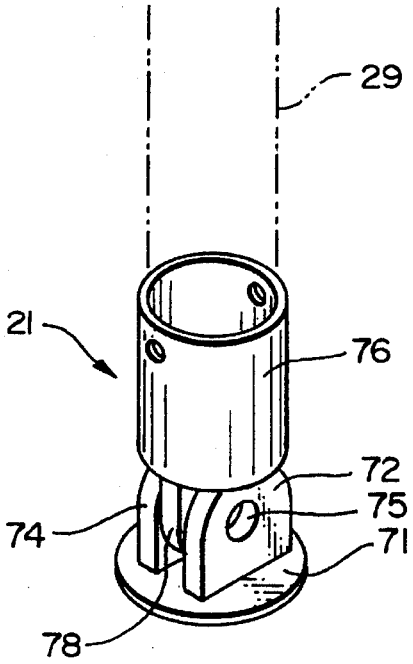
FIG. 10 is an isometric view of an exemplary mounting socket and base assembly suitable for mounting the rotatable tubular metal liftarm of the present invention to the deck of a conventional sailboat or similar vessel; and, FIG. 11 is a side elevational view similar to FIG. 3B, but here illustrating a modified form of the invention employing a pair of internal concentric telescoped tubular stiffening members.

In accordance with another important aspect of the present invention, a mounting socket and base assembly 21 (FIGS. 1 and 2; but, best shown in FIG. 10) and a siderail mounting bracket assembly 31 (FIGS. 1 and 2; but best shown in FIG. 7) are provided for establishing two (2) vertically spaced mounting points for the mounting tube 29 so as to insure that the mounting tube 29 is installed in a substantially vertical orientation on the deck 22 of the sailboat 24 irrespective of the deck's camber and/or pitch—at least when the sailboat 24 is docked or moored in calm water. To accomplish this, and referring first to FIG. 10, it will be observed that the mounting socket and base assembly 21 includes a base plate 71 having a pair of spaced apart upstanding mounting lugs 72, 74 with a through aperture or bolt hole 75 extending laterally therethrough. The assembly 21 further includes a mounting socket 76 having an integral depending mounting lug 78 adapted to be positioned between the mounting lugs 72, 74 on the base plate 71 and provided with a comparable bore (not shown).

Thus, the arrangement is such that the base plate 71 can, as shown in the exemplary form of the invention depicted in the drawings, be positioned on the deck 22 of the sailboat 24 adjacent the gunwale 26 and inboard of the sailboat's siderail 30 with the mounting lugs 72, 74 positioned relative to the sailboat's deck camber and pitch so as to enable the socket 76 to pivot about a mounting pin or bolt 79 (FIG. 2) extending through the bore 75 in mounting lugs 72, 74 and through mounting lug 78, enabling orientation of the socket 76 on a substantially vertical longitudinal axis. However, those skilled in the art will appreciate that the invention is not limited to any particular placement on the sailboat's deck 22 and it can be mounted outside the siderail 30, on the stern 28, on the foredeck (not shown) or, for that matter, in virtually any desired location. Indeed, in its broadest aspects, the invention can be used on piers, floats, loading docks or virtually any other location where it is desirable to transfer loads between 2 points whether located on different planes or on the same plane.

In the illustrative and exemplary form of the invention, the tubular socket 76 is preferably made of stainless steel tubing having an O.D. of approximately 1.75 inches, a wall thickness of approximately 0.062 inches, and an I.D. of approximately 1.626 inches. The lower end of the mounting tube 29—which nominally has an O.D. of approximately 1.625 inches—is then inserted into the socket 76. Following insertion into the socket 76—which has been fixedly secured to the deck 22 of the sailboat 24 in the manner previously described hereinabove—the mounting tube 29 is rotated about its longitudinal axis until the sheave 56 mounted within sheave box 41 lies in a vertical plane bisecting the closest and most accessible cockpit winch 42. At this point, holes are drilled in the lower end of the mounting tube 29 through, and in registration with, a pair of pre-formed diametrically opposed bolt holes 80 formed in the socket 76. Any suitable through bolt/nut combination 81 (FIG. 2) or other appropriate fastener is passed through the registering holes in the socket 76 and mounting tube 29 so as to fixedly secure the mounting tube to the mounting socket and base assembly 21 with freedom for the mounting tube 29 to be pivoted about bolt 79 into a substantially vertical position.

In order to secure the mounting tube 29 in a fixed substantially vertical position, mounting bracket assembly 31 (FIGS. 1 and 2; but best shown in FIG. 7) is provided for fixedly securing the upper end of the mounting tube 29 to the sailboat's siderail 30. To this end, the exemplary mounting bracket assembly 31 includes a three-piece separable clamping assembly comprising: i) a first U-shaped clamp member 82 having vertical flanges 84, 85 at its free ends; ii) a plate 86 having an axially extending bolt 88 integral therewith, with the plate 86 being welded or otherwise permanently affixed to the inner surfaces of the flanges 84, 85 and closing the open end of the U-shaped clamp member 82; and iii), a box-like C-shaped clamp member 89 adapted to be slideably mounted over the bolt 89 and the first U-shaped clamp member 82, with the U-shaped and C-shaped clamp members 82, 89 designed to surround the upper end of the mounting tube 29. A second inverted U-shaped saddle clamp member 90 having through bolt holes 91, 92 formed in respective ones of its parallel legs 94, 95 is positioned over the uppermost rail on the siderail 30 with the axially extending bolt 88 passing through the hole 91 in leg 94. If desired, the saddle clamp 90 can be rotated 90° and positioned over a vertical stanchion forming part of the siderail 30. A lock nut 96 is threaded onto the bolt 98 intermediate the legs 94, 95 and tightened down so as to tighten the first U-shaped clamp member 82 and the C-shaped clamp member 89 about the mounting tube 82 and causing the projecting free end of bolt 88 to project outwardly through bolt hole 92 in leg 95. Finally, the second U-shaped clamp member 90 is slid in a fore or aft direction on the siderail 30 (unless mounted on a vertical stanchion) until the mounting tube 29 is in a substantially vertical position, at which point the entire assembly is tightened and locked together by means of a washer 98 and lock nut 99.

Figure 8:
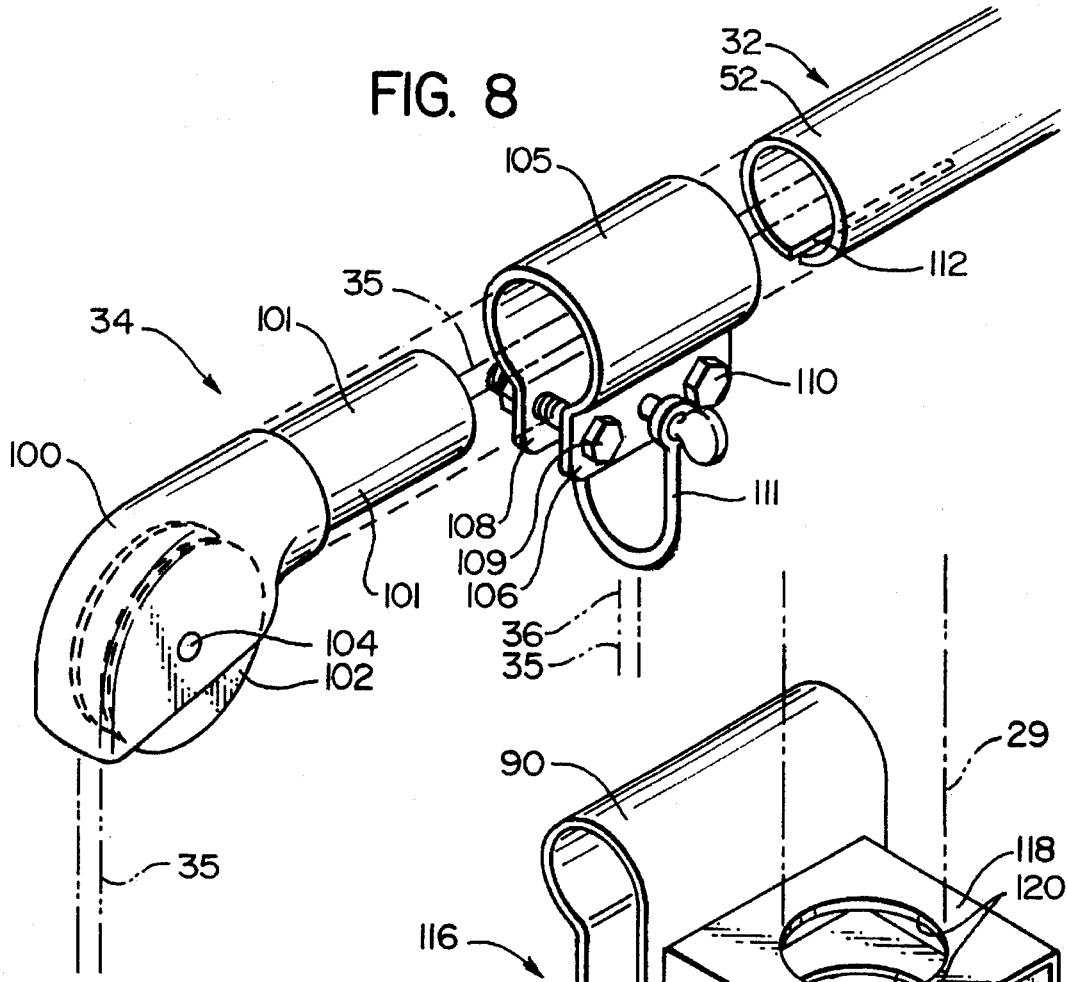
FIG. 8 is an exploded isometric view of the cast aluminum end fitting employed at the upper free cantilevered end of the rotatable tubular metal liftarm of the present invention.

Turning now to FIG. 8, details of an exemplary outboard sheave assembly 34 adapted to be fixed to the outboard free end of the rotatable tubular liftarm have been illustrated. Thus, as here shown, the exemplary sheave assembly 34 includes: i) a hollow cast aluminum fitting 100 having a laterally projecting reduced diameter tubular portion 101 with an O.D. of approximately 1.125 inches; ii) a sheave 102 journaled on a sheave pin 104 extending through the cast aluminum fitting 100; iii) a split O-shaped clamp 105 having a pair of spaced apart parallel flanges 106, 108; iv) a pair of bolt/nut combinations 109, 110 passing through flanges 106, 108; and v), a shackle 111 adapted to be secured to the free outboard end 36 of the load line 35. The free outboard end of the outer tube 52 defining the liftarm 32 is provided with a longitudinally extending slot 112 for a purpose described hereinbelow.

In assembly, the free end of the slotted tubular member 52 is inserted into the opposite inboard end of the split O-shaped clamp 105 and projected entirely therethrough until the outboard end of the tube 52 is substantially flush with the outboard end of clamp 105. The reduced diameter portion 101 of the cast aluminum fitting 100 is then inserted fully into the tube 52—i.e., until the reduced diameter portion 101 of fitting 100, the slotted end of tube 52, and the O-shaped clamp 105 are coaxial, concentric and coextensive. At this point, the bolt/nut combinations 109, 110 are tightened to firmly clamp the fitting's reduced end portion 101 within the slotted end portion of tube 52 and the O-shaped clamp 105. The slot 112 formed in the tube 52 permits the clamp 105 to be over-tightened, compressing the end of the tube 52 against the reduced diameter portion 101 of the fitting 100 and forming a secure connection therebetween.

In order to attach the load line 35 to the liftarm 32 and reeve the load line 35 through the rotatable tubular liftarm assembly 20, the outboard free end 36 of the load line 35 is securely attached to the shackle 111 on the split O-shaped clamp 105 in any suitable manner such, for example, as by tying the load line to the shackle and securely knotting the line. The free inboard end 40 of the load line 35 is then reeved: i) through the lift sheave assembly 38 (FIGS. 1 and 2) and about the sheave (not visible in FIGS. 1 and 2) journaled therein; ii) through the cast aluminum fitting 100 and about sheave 102 journaled therein; iii) through the concentric, coextensive reduced diameter portion 101 of fitting 100, the slotted end portion of tube 52, and the split O-shaped clamp; iv) downwardly through the outer tube 52 and through the inner stiffening tube 54 (FIGS. 2 and 3B); v) downwardly through the telescoped lower end of outer tube 52 and the mounting tube 29 (FIG. 5); and vi), through the sheave box assembly 41 and about sheave 56 journaled for rotation therein. As the free inboard end 40 of load line 55 exits the sheave box 41, it is led directly to the cockpit winch 42 (FIGS. 1 and 2) about which it can be wound when ready for use. To facilitate entry of the free inboard end 40 of the load line 35 into the sheave box assembly 41, a generally cylindrical feederbush 114 made of plastic material and having a funnel-shaped passageway 115 extending vertically therethrough (FIG. 5) is press-fit into the lower end of tube 52 prior to assembly and becomes a permanent part of the assembled liftarm 32.

Figure 9:
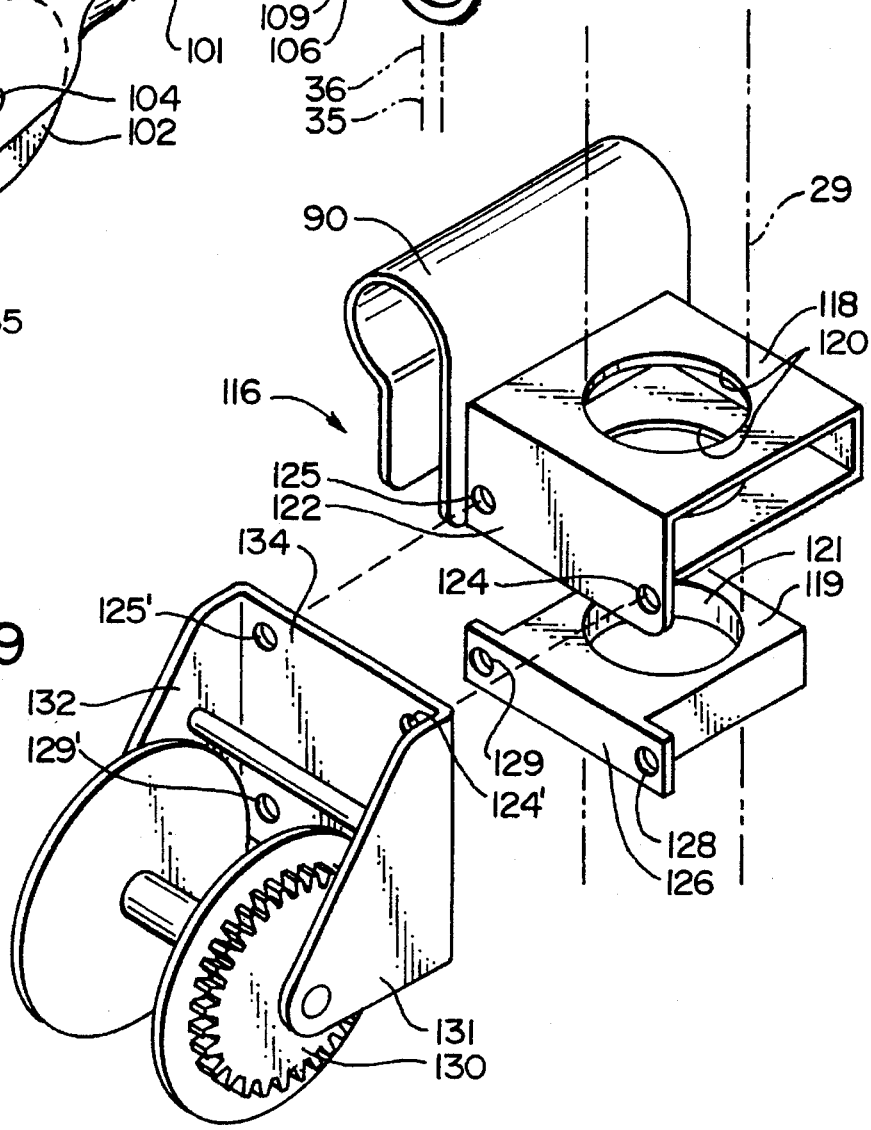
FIG. 9 is an exploded isometric view of an alternative siderail mounting assembly including a suitable winch mechanism for use with vessels that do not have a conveniently located cockpit winch.

Turning next to FIG. 9, an alternative winch arrangement has been depicted which is particularly advantageous for use in those applications where there is not a readily accessible and available cockpit winch of the type depicted at 42 in FIGS. 1 and 2. Thus, as here shown, a modified siderail mounting assembly, generally indicated at 116, is used in addition to the mounting bracket assembly 31 previously described in connection with FIGS. 1, 2 and 7. In this instance, mounting assembly 116 includes a pair of vertically spaced box-shaped brackets 118, 119 respectively having through vertical bores 120, 121 designed and dimensioned to be slideably mounted about the vertically extending mounting tube 29. The upper bracket 118 is shaped and designed to replace the clamp 89 of FIG. 7 and receives and houses the clamp member 82 of FIG. 7 (not shown in FIG. 9). Otherwise, the clamping arrangement of FIG. 7 continues to function in precisely the same manner as previously described.

In this instance, however, the upper bracket 118 is provided with an integral, depending vertical mounting flange 122 having a pair of bolt holes 124, 125 formed therein. Similarly, the lower bracket 119 is provided with a vertically spaced co-planar mounting flange 126 having a pair of bolt holes 128, 129 formed therein. A conventional clutch-type boat trailer winch 130—or alternatively, a small, self-tailing boat winch (not shown) or other conventional winch—is journaled for rotation between a pair of spaced vertical flanges 131, 132 integral with, and perpendicular to, a plate-like mounting bracket 134 having bolt holes 124', 125', 128', 129' adapted to be registered with respective ones of the bolt holes 124, 125 formed in mounting flange 122 in the upper bracket 118 and bolt holes 128, 129 formed in mounting flange 126 forming part of the lower bracket 119.

Thus, the arrangement is such that the winch 130 can be directly attached to the brackets 118, 119 by any conventional bolt/nut combinations (not shown) which extend through the registered bolt holes 124/124', 125/125', 128/128' and 129/129'. In such a modified construction, those skilled in the art will appreciate that when the mounting tube 29 is fixedly secured to the socket 76 of the mounting socket and base plate assembly 21 (FIGS. 1, 2 and 10), the mounting tube 29 will first be rotated within the socket 76 until the sheave 56 in the sheave box assembly 41 is aligned and centered vertically beneath the winch 130.

Figure 11:
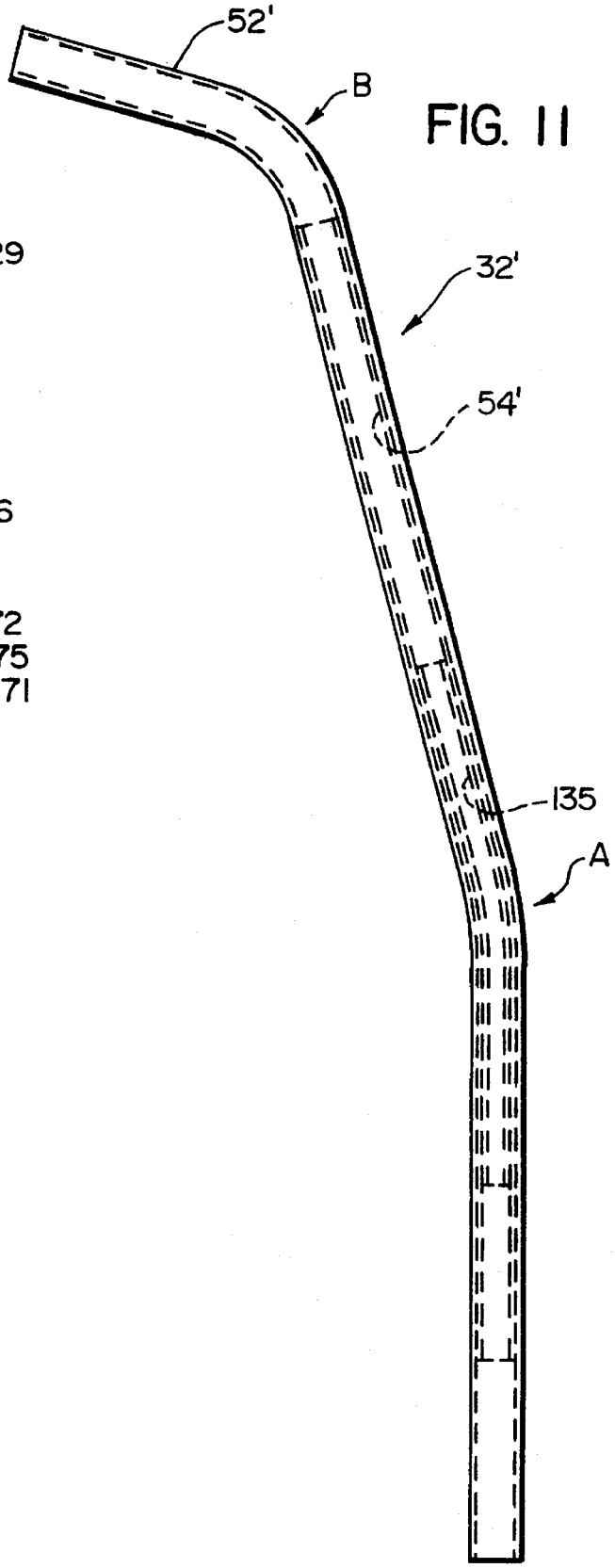

In those instances where the operator anticipates extraordinarily high loading on the liftarm assembly 20 depicted in FIGS. 1 and 2, it may be desirable to utilize a modified composite liftarm 32' as best shown in FIG. 11 where additional stiffening features are incorporated. In this modified construction, the outer tube 52' includes a first intermediate inner stiffening tube 54' and a second, smaller diameter, innermost stiffening tube 135 inserted coaxially within the intermediate stiffening tube 54'. In this exemplary embodiment, outer tube 52' is on the order of approximately 61 inches in length; inner tube 54' is approximately 38 inches in length extending from a point approximately 9.5 inches above the bottom of tube 52'; while the innermost internal stiffening tube 135 is approximately 16 inches in length and is centered within the region "A" where the lower bend is formed. Consequently, when the composite array of concentric tubes 52', 54', 135 are bent in the region "A", preferably through an angle of approximately 15°, all three (3) tubes are firmly locked in position. The bend in the region "B" is again a bend in only the outermost tube 52'; and, in the exemplary embodiment of the invention, comprises a bend on the order of approximately 50°.

Again, the foregoing dimensions are not critical to the present invention provided only that the relative dimensions and the location of the bends in regions "A" and "B" remain substantially proportional to those described above. The diameters of the tubes 52', 54' may be the same as previously described, in which event the O.D. of tube 135 must be approximately 0.995 inches. However, the diameters of the various tubular members 29, 52, 52', 54, 54', 76, and 135 are not critical provided only that the various tubes are dimensioned such that they can be telescopically mounted together in the manner described hereinabove.

Thus, those skilled in the art will appreciate that there have hereinabove been described various modifications of a rotatable tubular metal liftarm assembly 20 (FIGS. 1 and 2) which are: simple; compact; inexpensive; completely devoid of exterior struts, braces, pins and similar undesirable protuberances; and, devoid of internal sheaves and/or pulleys disposed within the cantilevered-type composite liftarm 32. Nevertheless, the device is rugged and capable of free, but controlled, rotational movement about a vertical axis between inboard and outboard positions. Loads supported by the rotatable liftarm assembly 20 do not impose rotational forces thereon; and, consequently, there is no inherent tendency of the liftarm 32 and any supported load to swing either inboard or outboard, or to otherwise deviate from a pure vertical up and/or down path unless the operator deliberately elects to rotate the liftarm 32 about its vertical axis so as to swing supported loads either inboard or outboard. The present invention further takes advantage of the capabilities of conventional cockpit winches, whether manually or electrically operated, which are characterized by having power ratios on the order of at least 16:1. Further, the danger of twisting, fouling or otherwise snagging the load line 35 or its free inboard end 40 is substantially eliminated.

The device may be easily used by even unskilled personnel including men and woman, both adult and teenagers, without significant risk, to transfer loads weighing up to several hundred pounds. Indeed, during an experimental rescue operation, a liftarm assembly embodying the present invention was successfully used by a woman weighing on the order of only about 110 pounds to rescue a distressed man in the water; and, the woman was able to easily lift the man aboard the sailboat despite the fact that the man weighed in excess of 200 pounds.

I claim:

1. A cantilevered rotatable tubular metal liftarm assembly comprising, in combination:

a) a mounting socket and base assembly having a base plate and a tubular socket pivotably secured thereto for pivotal mounting about a horizontal axis, said base plate being fixedly securable to any suitable support surface;

b) a vertically extending mounting tube non-rotatably secured to said pivotable mounting socket, said mounting tube including:

i) a sheave box extending diametrically through said mounting tube adjacent the lower end thereof; and, ii) a first inboard shears journaled in said sheave box for rotation about a horizontal axis, said sheave projecting radially outward through and beyond said mounting tube;

c) means for clamping the upper end of said mounting tube to any suitable support structure for maintaining said mounting tube in a vertical position;

d) a tubular liftarm mounted in said mounting tube for rotation about a vertical axis, said tubular liftarm including:

i) a first lower linear portion for rotatable telescopic mounting within said mounting tube above said sheave box;

ii) a second cantilevered upper linear outboard portion having an outboard end; and, iii) a third intermediate linear portion joined said first lower portion by smoothly curved regions;

said tubular liftarm being devoid of:

iv) internal sheaves and pulleys; and, v) external supports, braces and struts for supporting said second cantilevered upper linear outboard portion of said tubular liftarm;

e) a fitting defining an outboard sheave assembly coupled to said outboard end of said second cantilevered upper linear outboard portion of said liftarm, said fitting having a second outboard sheave journaled therein for rotation about a horizontal axis;

f) a load line having free inboard and outboard ends, said free outboard end of said load line being secured to said cantilevered upper outboard portion of said liftarm, and said free inboard end of said load line being reeved:

i) through said outboard shears assembly and about said second outboard sheave;

ii) through said upper, intermediate and lower portions of aid liftarm and through said mounting tube surrounding said lower portion of said liftarm; and, iii) to and through said sheave box and about said first inboard sheave with said free inboard end of said load line extending laterally from said mounting tube and said sheave box projecting radially therefrom for attachment to any suitable winch;

whereby, the portion of said load line intermediate said free outboard end thereof which is secured to said second cantilevered upper outboard portion of said liftarm and said outboard sheave assembly defines a vertically oriented bight; and, g) a sheave block containing a sheave journaled for rotation about a horizontal axis and a lift hook coupled to the lower end of said bight for raising and lowering loads as said load line is respectively paid in and out.

2. A cantilevered rotatable tubular metal liftarm assembly as set forth in claim 1 wherein one of said base plate and said tubular socket has a pair of vertically extending spaced apart mounting lugs, the other has at least one vertically extending mounting lug adapted to be positioned between said spaced apart mounting lugs, and a pivot pin extends horizontally through all of said mounting lugs for pivotably mounting said socket on said base plate.

3. A cantilevered rotatable tubular metal liftarm assembly as set forth in claim 1 wherein said sheave box contains a U-shaped member having a vertically extending backwall and a pair of vertically extending spaced apart parallel sidewalls, a sheave pin lying in a horizontal plane having its opposite ends mounted in respective ones of said pair of spaced apart parallel sidewalls, and said inboard sheave is located in a vertical plane intermediate said pair of spaced apart parallel sidewalls and is journaled for rotation about said sheave pin.

4. A cantilevered rotatable tubular metal liftarm assembly as set forth in claim 3 further including a smooth curved deflector having one end thereof mounted on the upper portion of said backwall of said U-shaped member and extending in slightly spaced apart relation below said inboard sheave, said deflector having its opposite lower free end extending out of said sheave box and being secured to said mounting tube.

5. A cantilevered rotatable tubular metal liftarm assembly as set forth in claim 3 further including a thrust washer seated within said mounting tube and on the upper surfaces of said U-shaped member in said sheave box, said thrust washer defining a thrust surface against which the bottom end of said first lower linear portion of said titular liftarm is seated.

6. A cantilevered rotatable tubular metal liftarm assembly as set forth in claim 5 further including a pair of vertically spaced sleeve bearings press-fit into opposite ends of said mounting tube with said bearings being located intermediate said mounting tube and said first lower linear portion of said liftarm.

7. A cantilevered rotatable tubular metal liftarm assembly as set forth in claim 1 further including a feederbush mounted within the lowermost end of said first lower linear portion of said liftarm, said feederbush having a substantially funnel-shaped axial passageway extending therethrough for facilitating reeving of said load line into said sheave box.

8. A cantilevered rotatable tubular metal liftarm assembly as set forth in claim 6 further including a feederbush mounted within the lowermost end of said first lower linear portion of said liftarm, said feederbush having a substantially funnel-shaped axial passageway extending therethrough for facilitating reeving of said load line into said sheave box.

9. A cantilevered rotatable tubular metal liftarm assembly as set forth in claim 1 wherein said tubular liftarm includes a first tube defining said first lower linear portion, said second cantilevered upper linear portion, and said third intermediate linear portion.

10. A cantilevered rotatable tubular metal liftarm assembly as set forth in claim 9 further including a second tube telescopically mounted within said first tube and extending above and below said smoothly curved region joining said first lower linear portion and said third intermediate linear portion for stiffening said tubular liftarm in said curved region.

11. A cantilevered rotatable tubular metal liftarm assembly as set forth in claim 10 further including a third tube telescopically mounted within said second tube and extending above and below said smoothly curved region joining said first lower linear portion and said third intermediate linear portion for stiffening said tubular liftarm in said curved region.

12. A cantilevered rotatable tubular metal liftarm assembly as set forth in claim 1 further including a winch mounted on said means for clamping said mounting tube to any suitable support structure.

13. A composite tubular liftarm for use with a cantilevered rotatable tubular metal liftarm assembly, said composite tubular liftarm comprising, in combination:

a) a first relatively long tubular member;

b) a second relatively short tubular stiffening member, said second tubular stiffening member having an O.D. substantially the same as the I.D. of said first tubular member and being telescopically inserted into first tubular member and located in a region spaced vertically above the bottom of said first tubular member;

c) said first tubular member and said second tubular stiffening member being bent through a smooth curve and defining an included angle with respect to a vertical longitudinal axis extending through the lower portion of said first tubular member on the order of from about 15° to about 16.5° with said smoothly curved bend being located intermediate the upper and lower ends of said second tubular stiffening member;

d) said first tubular member being bent in a region spaced vertically above said second tubular stiffening member through a smooth curve and defining an included angle with respect to the adjacent first bent portion of said tubular liftarm of on the order of about 50° to about 60°; and, e) said first relatively long tubular member being devoid of:

i) internal sheaves and pulleys; and, ii) external supports, braces and struts for supporting the bent portions of said first tubular member;

whereby, said tubular metal liftarm comprises a first lower linear portion, a second intermediate linear portion, and a third cantilevered upper portion with said first and second portions and said second and third portions each coupled by continuous smoothly bent curved regions wherein said continuous smoothly bent curved region coupling said first and second linear portions is reinforced by said second tubular stiffening member.

14. A composite tubular liftarm as set forth in claim 13 further including a third relatively short tubular stiffening member, said third tubular stiffening member having an O.D. substantially the same as the I.D. of said second tubular member and being telescopically inserted into said second tubular member and located in a region spaced vertically above the bottom of said second tubular member; and, wherein said first, second and third tubular stiffening members are bent through a smooth curve and define an included angle with respect to a vertical longitudinal axis extending through the lower portion of said first tubular member on the order of from about 15° to about 16.5° with said smoothly curved bend being located, intermediate the upper and lower ends of said third tubular stiffening member.

15. A composite tubular liftarm as set forth in claim 13 further including a feederbush mounted within the lowermost end of said first lower linear portion of said liftarm, said feederbush having a substantially funnel-shaped axial passageway extending therethrough for facilitating reeving of a load line out of said liftarm.

16. A composite tubular liftarm as set forth in claim 14 further including a feederbush mounted within the lowermost end of said first lower lineal portion of said liftarm, said feederbush having a substantially funnel-shaped axial passageway extending therethrough for facilitating reeving of a load line out of said liftarm.

17. A rotatable tubular metal liftarm mechanism suitable for use in on-loading and off-loading loads to and from a watercraft; said rotatable tubular metal liftarm mechanism comprising, in combination:

a) a tubular socket;

b) attachment means for permanently affixing said tubular socket to the deck of the watercraft with the axis passing longitudinally through said socket lying in a substantially upright vertical plane;

c) a hollow, linear mounting tube having an upper end and a lower end, said lower end of said mounting tube being telescopically mounted with respect to said tubular socket and having its vertical axis extending longitudinally through said mounting tube in an upright vertical pane, said mounting tube including:

i) a sheave box having a first sheave rotatably journaled therein for rotation about a horizontal axis, said shears box having its rearmost portion extending diametrically into and through said mounting tube with said first shears lying in a vertical plane and projecting partially into said mounting tube, said sheave box being affixed to said mounting tube and having a first opening communicating with the interior of said mounting tube and a second opening communicating with the exterior of said mounting tube beneath said first shears;

ii) means defining a smoothly curved deflector fixed at one end to the rear portion of said sheave box adjacent said first opening and extending about a portion of said first sheave in spaced apart relation with respect thereto, said smoothly curved deflector extending out said second opening and being affixed to said tubular mounting member; and, iii) means for non-rotatably securing said mounting tube to said tubular socket with said second opening in said sheave box directed in a preselected desired direction;

d) a rigid tubular liftarm formed of tubing, said liftarm having a vertically extending lower portion adapted to be telescopically mounted on said upper end of said hollow linear mounting tube with freedom for rotational movement with respect thereto shout a substantially vertical axis, said rigid tubular liftarm having a laterally extending upper portion with said lower portion and said upper portion being interconnected by means of a smoothly curved intermediate portion defined by at least one bend formed therein with said at least one bend defining an included angle between said vertically extending lower portion and said laterally extending upper portion in the range of about 65° to about 76.5°, the entire length of said rigid tubular liftarm including said lower, intermediate and upper portions being devoid of rollers, sheaves or inwardly projecting protuberances;

e) an end fitting telescopically mounted on the free end of said laterally extending upper portion of said rigid tubular liftarm, said end fitting having:

i) a first opening communicating with the interior of said rigid tubular liftarm;

ii) a second downwardly facing opening outboard of the free end of said lateral portion of said rigid tubular liftarm and communicating with said first opening; and, iii) a second shears rotatably journaled about a horizontal axis extending through said end fitting with said second sheave lying in a vertical plane bisecting said first and second openings in said end fitting;

f) a load line having first and second ends with said first end fixedly secured to at least one of said end fitting and said laterally extending portion of said rigid tubular liftarm, said load line having its second end projected through said second downwardly facing opening in said end fitting about said second sheave and through said first opening in said fitting into the interior of said laterally extending upper portion of said rigid tubular liftarm with said load line being reeved through said laterally extending upper portion, said smoothly curved intermediate portion, and said vertically extending lower portion of said rigid tubular liftarm and through said first opening in said sheave box about said first sheave and outwardly through said second opening in said shears box for permitting attachment of said second end of said load line to a suitable winch, the portion of said load line intermediate said first end and said end fitting defining an adjustably sizable bight lying in a vertical plane; and, g) a third sheave having means defining a load lifting hook mounted on said bight in said load line; whereby, said means defining a load lifting hook can be attached to a suitable load, said load line can be paid in about the winch to shorten said bight and raise the load or paid out about the winch to lengthen said bight and lower the load, and wherein said rigid tubular liftarm can be freely rotated about the vertical axis passing through its vertically extending lower portion when the load is in a raised position to shift the load between a first inboard position over the watercraft's deck or other suitable storage area and a second position outboard of the watercraft.

18. A rotatable tubular metal liftarm mechanism as set forth in claim 17 wherein said smoothly curved intermediate portion of said rigid tubular liftarm includes first and second linear portions interconnected by a first bend region and a third linear portion interconnected to said second linear portion by a second bend region with said first linear portion extending vertically and said third linear portion extending laterally.

19. A rotatable tubular metal liftarm mechanism as set forth in claim 18 having a tubular stiffening sleeve mounted telescopically with respect to the upper end of said first linear portion, said first bend region, and the lower end of said second linear portion in snug fitting face-to-face contact therewith.

20. A rotatable tubular metal liftarm mechanism as set forth in claim 18 having a funnel-shaped insert fixedly positioned in the lower end of said first linear portion of said rigid tubular liftarm for guiding said second end of said load line into and through said first opening in said sheave box and intermediate said smoothly curved deflector and said first sheave.

21. A rotatable tubular metal liftarm mechanism as set forth in claim 17 wherein said attachment means includes a flat mounting plate for fixed but removable attachment to the watercraft's deck and a pair of upstanding spaced apart mounting lugs formed integrally with said plate; said tubular socket includes a downwardly extending integral mounting lug sized to fit snugly between said pair of mounting lugs; and, a pivot pin extending through said pair of mounting lugs on said flat plate and said mounting lug on said socket for pivotally securing sad socket to said plate.

22. A rotatable tubular metal liftarm mechanism as set forth in claim 17 further including a clamp assembly for securing the upper end of said hollow linear mounting tube to one of the watercraft's siderail or an upright vertical stanchion supporting the watercraft's siderail, said clamp assembly including:

i) a tubular clamp portion sized to surround said hollow linear mounting tube with freedom for up/down sliding motion with respect thereto;

ii) means for tightening said tubular clamp so as to affix said tubular clamp to said hollow linear mounting tube at a desired elevation;

iii) a saddle clamp sized to partially surround one of the watercraft's siderail or a vertical stanchion supporting the watercraft's siderail at a particular desired fore/aft position with respect thereto;

iv) means for tightening said saddle clamp so as to affix said saddle clamp to one of the watercraft's siderail or a vertical stanchion supporting the watercraft's siderail at a desired point;

v) means for coupling said saddle clamp to said tubular clamp with freedom for relative rotation therebetween about an axis passing horizontally through said saddle clamp and said tubular clamp; and, vi) means for tightening said coupling means to affix said saddle clamp to said tubular clamp;

whereby, said hollow linear mounting tube can be oriented in a fixed upstanding vertical position substantially perpendicular to a horizontal plane and fixedly clamped to the watercraft's deck and support rail structure at two spaced points.

23. A rotatable tubular metal liftarm mechanism as set forth in claim 22 further including a winch mounted on said clamp assembly.

* * * * *